United States Patent [19]

Howie

[11] Patent Number: 4,852,562

[45] Date of Patent: Aug. 1, 1989

[54] HELMET

[75] Inventor: Robin M. Howie, Edinburgh, Scotland

[73] Assignee: Coal Industry (Patents) Limited, United Kingdom

[21] Appl. No.: 158,650

[22] Filed: Feb. 22, 1988

[30] Foreign Application Priority Data

Mar. 6, 1987 [GB] United Kingdom ..... 8705261

[51] Int. Cl.[4] ..... A62B 7/00

[52] U.S. Cl. ..... 128/201.25; 128/201.23; 128/201.24; 128/201.22; 128/205.29; 2/171.3

[58] Field of Search ..... 128/201.22, 201.23, 128/201.24, 201.25, 200.27, 200.28, 201.14, 204.25, 204.15, 205.29, 206.12, 206.21, 205.25; 2/171.3, 171.4, 424

[56] References Cited

U.S. PATENT DOCUMENTS

| | | | |
|---|---|---|---|
| 3,822,698 | 7/1974 | Guy | 128/201.25 |
| 4,090,510 | 5/1978 | Segersten | 128/206.12 |
| 4,186,736 | 2/1980 | Angioletti et al. | 128/201.19 |
| 4,309,774 | 1/1982 | Guzowski | 2/171.3 |
| 4,498,202 | 2/1985 | Yamamoto | 2/171.3 |
| 4,549,542 | 10/1985 | Chien | 128/201.24 |

FOREIGN PATENT DOCUMENTS

| | | |
|---|---|---|
| 0078110 | 5/1983 | European Pat. Off. . |
| 3306691 | 9/1984 | Fed. Rep. of Germany . |
| 1426432 | 5/1973 | United Kingdom . |
| 1495020 | 1/1975 | United Kingdom . |
| 2014036 | 8/1979 | United Kingdom . |
| 2032284 | 5/1980 | United Kingdom . |
| 2063074 | 6/1981 | United Kingdom . |

OTHER PUBLICATIONS

PCT International Appln. No. PCT/US81/00244, International Publication Date: 9-81.
United Kingdom Search Report.
European Search Report.

*Primary Examiner*—Edgar S. Burr
*Assistant Examiner*—Kimberly L. Asher
*Attorney, Agent, or Firm*—Stevens, Davis, Miller & Mosher

[57] ABSTRACT

A powered respirator helmet comprises a shell, having a passage, between a filter medium, and a fan, mounted in the front peaked part of the helmet shell. An air intake permits air to be drawn by the fan through the filter medium, through the passage and to be exhausted by the fan into the space between a wearer's face and a visor. The helmet is more compact, lighter and less expensive to service than existing respirator helmets, while providing more effective respiratory protection.

6 Claims, 1 Drawing Sheet

HELMET

Figure 1:
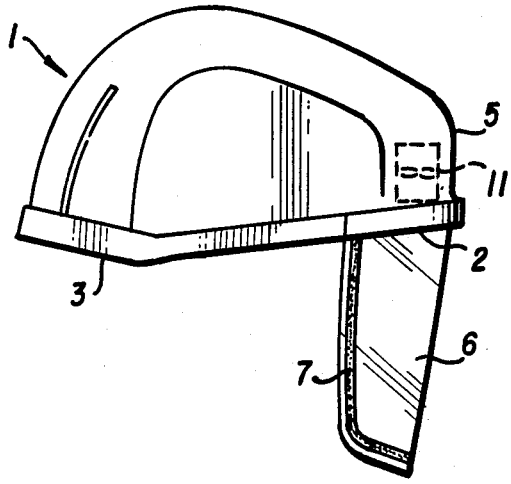

This invention concerns an improved helmet, more particularly it concerns the type of helmet providing filtered air to a user.

A number of powered filter helmets have been proposed, and marketed, of which the most successful is the "Airstream" (RTM) helmet manufactured by Racal Safety Ltd. Although the "Airstream" arose from research work by the Safety in Mines Research Establishment which was intended for mining application, the helmet has not gained as much acceptance in coal mining as in certain other industries. We refer to UK Patent Specification Nos. 1,426,432 and 1,495,020 which relate to the principles behind the "Airstream" helmet, in particular the use of a fan mounted at the back of the helmet, impelling air through a bag-type filter overlying the crown of the wearer's head. A viser is attached to the front of the helmet and the filtered air is directed between the face of the wearer and the visor, and escapes around the chin. The concept of using a visor to contain a curtain of filtered air is well established; such a visor also protects the wearer from airborne particles or droplets. European Patent Specification No. 0047296 relates to another powered filter helmet and visor arrangement, having a fan unit at the back of the helmet and a filter on top of the helmet. It can be observed from the drawings of the said patent specifications that the known powered filter helmet has to be enlarged considerably to accommodate the fan and filter, giving increased height and protrusion at the back of the head.

It has also been proposed in U.S. Pat. No. 3,258,010 to incorporate a filter in a protective headgear using a flow of filtered air inside a visor. Other relevant patent publications include U.S. Pat. Nos. 3,649,964, and 3,822,698 also discloses a helmet having a fan, filter and visor, the fan being mounted on top of the helmet or in a central position above the peak of a "hard-hat", and drawing air from the atmosphere and impelling the air through the filter.

The present invention provides a novel powered respirator helmet, comprising a visor attached to a helmet shell, said shell having a front peaked part and a rear part and a head harness mounted therein, at least one air intake between the rear part of the shell and the corresponding part of the wearer's head, a filter medium arranged within the rear part of the shell, at least one passage for filtered air within the shell and connecting with the filter medium and also connecting with twin or triple fans mounted within the front part of the shell and at least one opening for air from the fans to the space between the visor and a wearer's face, so arranged and constructed that in operation air is drawn by the fans from the region between the shell and the wearer's head and through the filter medium to provide a stream of filtered air, the filtered air passes through the passage to the fans and is exhausted through said outlet. In one embodiment, the helmet has two fans mounted above the peaked part, and more preferably said two fans are spaced apart by a distance adequate to permit the mounting of a cap lamp on the shell in its customary position above the peak. In an alternative embodiment, the fans are mounted at the side of the helmet, generally above or forward of the wearer's ears.

The helmet shell may be manufactured in known manner and with known materials, and desirably has one or more passages moulded or otherwise formed therein. Said passage or passages may have three of four walls formed by the shell and may be completed by an appropriate wall part affixed in position. Preferably, the passage(s) extend from the rear part of the shell to the front part.

The filter medium may be a pad or shaped area of a suitable filter material, of which a bonded non-woven fibre sheet has been found to be suitable. Preferably, the filter medium is mounted by being trapped between a filter holder and parts of the shell, providing that the shell provides adequate connection between the filter medium and the said passages. A preferred filter holder is a removable perforate support for the filter, capable of providing adequate sealing of the filter to prevent contaminated air from being drawn into the passage and permitting a rapid change of the filter medium. Some environments, for example in coking works in which tarry particles are deposited on the filter, are such as to require a filter change after each working shift, and the preferred apparatus permits quick and simple exchange of filter media, and the filters themselves are less expensive than more complex bag-type filters. The filter medium is preferably arranged in the rear part of the helmet shell.

The fans may be of centrifugal, axial or mixed-flow type, but twin commercial axial flow fans of about 0.3–0.4 watt power requirement (drawn from a cap lamp battery worn on a belt) have been found to be effective. The fans are desirably resiliently mounted in the shell or on a flange or other part mounted on the shell, in order to reduce noise and vibration perceived by a wearer, although in general it has been found that the prototype powered respirator helmet according to the invention is less noisy, at 70–80 dB, than many of the working environments in which the helmet would be used. Each of the fans may itself be formed by a pair of fans in tandem; this may provide performance gains but at extra cost.

The visor is suitably of any clear protective plastics material, and may be hinged to the helmet shell, or, preferably, removably mounted thereon. The visor may be disposable or have one or more disposable protective films thereon, to maintain good visibility in the event of abrasion or deposit of particles or droplets.

The visor may comprise complete or partial peripheral sealing strips, for example of a soft synthetic foam, which are effective to contain the flow of filtered air. It is desirable at least for certain contemplated environments such as underground mining, to substantially seal the visor against the face of the wearer so as to prevent leakage of contaminated air into the wearer's breathing zone, especially at high wind velocities. The path of excess air and exhalations from the visor is not critical and these may be allowed to leak out past the temples of a wearer or through the sealing strips. However, a seal may be incorporated between the helmet and the head band of the head harness inside the shell, to prevent leakage over the wearer's head. Other methods of exhaustiong air and exhalations, including the use of exhaust valves or passages, may be used providing the helmet meets the desired requirements for wearer protection from contaminants. It will be appreciated that the fans operate on the downstream side of the filter medium, with the result that they operate in a much cleaner air stream than with prior helmets, with beneficial results on fan life. The cost of replacement fans, and the servicing required, are a substantial part of the running cost of conventional powered helmet respirators.

According to the invention, the mounting of the fans within the front part of the helmet shell utilizes a "dead" space which is otherwise not occupied, and a prototype helmet shell is not more than 1cm higher and 1cm deeper at the rear than a standard helmet without any fan and filter, and is very much more compact than any previously marketed powered respirator helmet. The weight and inertia of the helmet according to the invention may also show substantial improvements.

It will be understood that the design stage for a helmet according to the invention should ensure compliance with safety requirements for the contemplated uses, for example Intrinsic Safety requirements.

For use in mining environments, the cap lamp should be mounted as close as possible to the wearer's head, so as to minimise the turning moment and moment of inertia caused by the cap lamp. In the prototype helmet more particularly described hereinafter, the cap lamp mounting is substantially closer to the wearer's head than in currently available mining helmet respirators.

Figure 2:
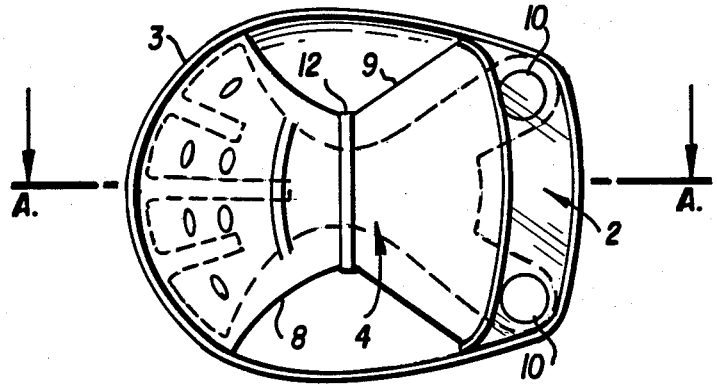
Figure 3:
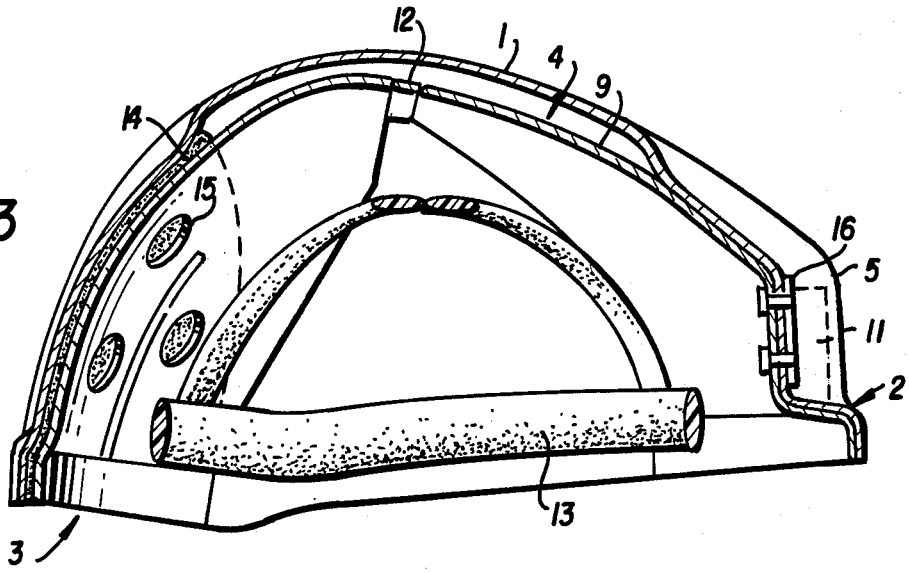

The invention will now be described by way of example only, with reference to the accompanying drawings, in which FIG. 1 is a side view of one embodiment of the present invention, FIG. 2 is a bottom view of the helmet of FIG. 1, with visor removed and not showing the head harness; and FIG. 3 is a cross-sectional view of the helmet of FIG. 2, along the line A—A.

Referring to FIGS. 1 and 2 a powered helmet respirator comprises a moulded ABS (acrylonitrile-butadiene Styrene) shell 1, having a front peaked part, 2, and a rear part 3. The shell incorporates a bifurcated flow channel shown in broken lines, 4, extending from the rear part to two moulded protuberances, 5, which act as fan housings. A clear plastics visor, 6, is attached, eg. by snap fasteners, to the peaked part, and a peripheral foam plastics seal, 7, is adhered to the visor and is of sufficient depth to bear against a wearer's face to minimize inleakage of contaminated air. The snap fasteners can also function as pivot points, so permitting the visor to be swung upwards when not required. It will be understood that the helmet shell and the visor comply with the relevant requirements for safety helmets and eye protectors respectively.

Within the shell, a filter holder, 8, is mounted at the rear part and has protruding ribs corresponding in position to indentations on the shell. A simple fastening such as snap fasteners around the rim of the rear part of the helmet shell is effective to position the filter holder and trap a filter (more fully described with reference to FIG. 3). Mounted in the front of the shell is a fan support 9, having two apertures, 10, above which are resilently mounted plastics-bodied axial fans, 11. A plastics sealing strip, 12, joins the filter holder, 8, and the fan support, 9, to prevent air leakage from the flow channel, 4.

Referring now to FIG. 3, a head harness, 13, is mounted onto the filter holder and the fan support. A shaped commercial filter cloth, 14, is trapped and sealed in position between the filter holder and corresponding parts of the shell, around the rim of the rear part of the shell and around the peripheries of the flow channel, 4. The filter holder has a number of openings, 15, which permit air drawn between the rear of the shell and the wearer's head to pass through the filter into the flow channel, 4. In the recess in the helmet peaked part, between protuberances, 5, is fixed a cap lamp mount, 16. Because of the use of two fans offset from the centre line of the helmet, a cap lamp mounted on the helmet does not extend beyond a cap lamp on a normal coal miner's helmet of the "hard-hat" type.

In operation, the fans 11 are powered by a cap-lamp battery (not shown) worn on a belt. The fans are capable of moving 180–200 l/min of air, by reducing the pressure in flow channel 4 and air is drawn through openings 15 and is filtered. The air is exhausted through apertures 10 to the space between the visor and a wearer's face, and excess air is allowed to leak past the wearer's temples, and/or through the foam sealing strips.

Since the fans operate in filtered air, they do not require replacement so often as fans operating in contaminated air. The replacement of the filter requires only a few minutes to unfasten the filter holder, remove the used filter, insert a new filter and reposition the filter holder. The labour costs of servicing are also minimized by the use of an inexpensive disposable visor assembly.

The helmet respirator described above offers a higher level of respiratory protection in the high ventilation velocities found in the mining environment than any alternative helmet respirator currently available for use in coal mines.

I claim:

1. A powered respirator helmet comprising a helmet shell, a visor attached to the helmet shell, said shell having a front part and a rear part and a head harness mounted therein so as to define an open region between the inside of the helmet shell and the head harness, at least one air intake means in said open region between the rear part of the shell and the head harness, a filter medium, a removable perforate filter holder for holding said filter medium within the rear part of the shell, at least one passage means in said open region for enabling air to pass through the filter medium and thereafter within the shell;

at least two fans mounted within the front part of the shell and down stream from said filter medium and in communication with said passage means;

at least one means defining an opening for air to pass from the fans to a space between the visor and a wearer's face, whereby in operation air is drawn by the fans through the filter medium and through the region between the shell and the head harness to provide a stream of filtered air, the filtered air passes through the passage means to the fans and is exhausted through said opening.

2. A helmet according to claim 1, comprising a pair of fans mounted within the shell in an upper portion of said front part.

3. A helmet according to claim 2, wherein the fans are spaced apart and a mounting for a cap lamp is provided on the shell between said fans.

4. A helmet according to claim 1, wherein the fans are mounted at side of the helmet, generally forward of the wearer's ears.

5. A helmet according to claim 1, wherein the passage means for filtered air is formed in the shell material.

6. A helmet according to claim 1, wherein the visor has a peripheral sealing strip for contact with the wearer's face.

* * * * *